US010086389B2

(12) United States Patent
Williams

(10) Patent No.: US 10,086,389 B2
(45) Date of Patent: Oct. 2, 2018

(54) RANGE ENHANCED FIRE FIGHTING NOZZLE AND METHOD (CENTERSHOT II)

(75) Inventor: Dwight P. Williams, Vidor, TX (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 1201 days.

(21) Appl. No.: 12/451,687

(22) PCT Filed: May 28, 2008

(86) PCT No.: PCT/US2008/006739

§ 371 (c)(1),
(2), (4) Date: Nov. 23, 2009

(87) PCT Pub. No.: WO2008/153795

PCT Pub. Date: Dec. 18, 2008

(65) Prior Publication Data

US 2010/0163256 A1 Jul. 1, 2010

Related U.S. Application Data

(60) Provisional application No. 60/961,239, filed on Jul. 19, 2007, provisional application No. 60/932,315, filed on May 30, 2007.

(51) Int. Cl.

| | |
|---|---|
| ***A62C 31/03*** | (2006.01) |
| ***B05B 1/30*** | (2006.01) |
| ***B05B 1/12*** | (2006.01) |
| ***B05B 1/28*** | (2006.01) |
| *B05B 1/06* | (2006.01) |
| *B05B 1/34* | (2006.01) |

(52) U.S. Cl.

CPC ..... *B05B 1/3073* (2013.01); *A62C 31/03* (2013.01); *B05B 1/12* (2013.01); *B05B 1/28* (2013.01); *B05B 1/06* (2013.01); *B05B 1/34* (2013.01)

(58) Field of Classification Search

CPC ..... A62C 31/02; A62C 31/05; A62C 31/03; B05B 1/3073; B05B 1/28; B05B 1/34; B05B 1/06; B05B 1/12

USPC ..... 239/437–441, 539, 541, 581.2, 583

See application file for complete search history.

(56) References Cited

U.S. PATENT DOCUMENTS

| | | | | |
|---|---|---|---|---|
| 1,011,315 | A * | 12/1911 | Canner | 239/441 |
| 2,376,881 | A | 5/1945 | Adolph | |
| 2,389,642 | A * | 11/1945 | Schellin et al. | 239/441 |
| 3,363,842 | A | 1/1968 | Burns | |
| 4,640,461 | A | 2/1987 | Williams | |
| 5,012,979 | A | 5/1991 | Williams | |
| 5,167,285 | A | 12/1992 | Williams et al. | |
| 5,312,041 | A | 5/1994 | Williams | |

(Continued)

FOREIGN PATENT DOCUMENTS

FR 2856603 A1 12/2004

OTHER PUBLICATIONS

Akron Brass, "Single Shutoff Saberjet Nozzles," web page printouts from website www.akronbrass.com.

(Continued)

*Primary Examiner* — Jason Boeckmann
(74) *Attorney, Agent, or Firm* — Foley & Lardner LLP

(57) ABSTRACT

An enhanced range and landing pattern, straight stream and fog, fire fighting nozzle including solid bore and annular discharge ports wherein the nozzle discharges an inner stream surrounded by an outer stream.

22 Claims, 8 Drawing Sheets

(56) References Cited

U.S. PATENT DOCUMENTS

| | | | | |
|---|---|---|---|---|
| 5,590,719 | A | 1/1997 | McLoughlin | |
| 5,779,159 | A * | 7/1998 | Williams et al. | 239/424.5 |
| 5,893,519 | A * | 4/1999 | Cavaretta et al. | 239/318 |
| 5,992,529 | A | 11/1999 | Williams | |
| 6,089,474 | A | 7/2000 | Marino | |
| 6,102,308 | A * | 8/2000 | Steingass et al. | 239/424.5 |
| 6,877,676 | B2 | 4/2005 | Saner | |
| 7,097,120 | B2 * | 8/2006 | Marino | 239/539 |
| 2002/0125015 | A1 * | 9/2002 | Crabtree et al. | 169/20 |
| 2004/0084192 | A1 * | 5/2004 | Crabtree | A62C 31/12 169/44 |
| 2009/0020629 | A1 | 1/2009 | Marino | |
| 2012/0085840 | A1 | 4/2012 | Marino | |

OTHER PUBLICATIONS

Task Force Tips, "A Guide to Nozzles," 2001.
Williams Fire & Hazard Control, "Williams Product Catalogue".
Rosenbauer, "RM 60E, The High-Performance Turret," web page printout from website www.rosenbauer.com.
National Foam, Inc., "Data Sheet #NDD180," product information brochure.
Elkhart Brass, "Master Stream, R.A.N.™—Raid Attack Nozzle," web page printout from website www.elkhartbrass.com.

* cited by examiner

FIG. 3D
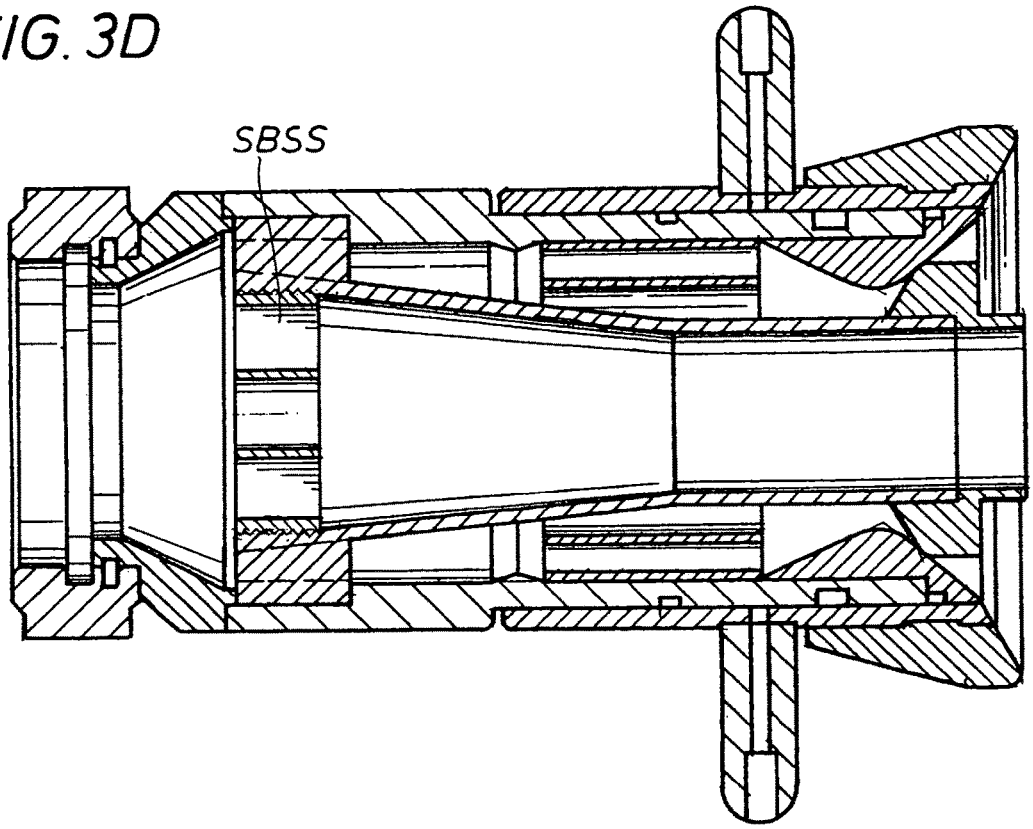
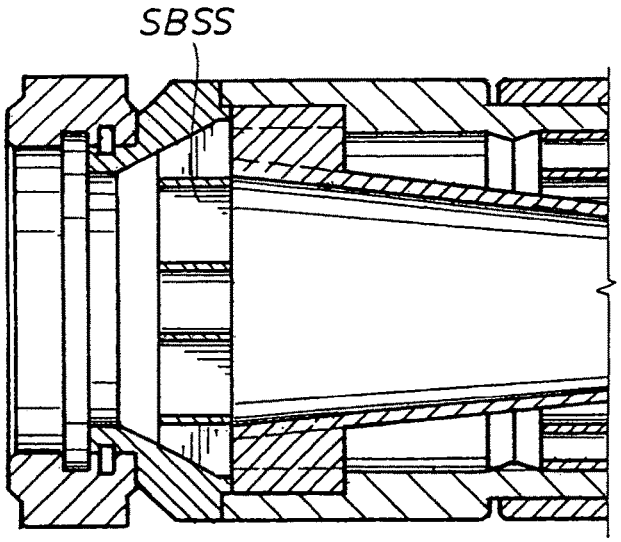
FIG. 3E

RANGE ENHANCED FIRE FIGHTING NOZZLE AND METHOD (CENTERSHOT II)

CROSS REFERENCE TO RELATED APPLICATIONS

This application is related to and claims priority to provisional U.S. Application Ser. No. 60/932,315, filed May 30, 2007, entitled A Range Enhanced Fire Fighting Nozzle and Method (Center Shot) and 60/961,239, filed Jul. 9, 2007, entitled A Range Enhanced Fire Fighting Nozzle and Method (Center Shot II), both having inventor Dwight P. Williams, the contents of both of which are also hereby incorporated herein by reference in their entirety.

FIELD OF THE INVENTION

The invention relates to fire fighting nozzles and associated methodology, and in particular to a range optimized fire fighting nozzle having at least a 95 gpm capacity, and preferably 500 gpm or greater capacity, adapted for fighting industrial fires including large industrial tank fires.

BACKGROUND OF THE INVENTION

Fires and hazards of fire (or associated environmental dangers) associated with industrial tanks for storing liquid petrochemicals and other chemicals are typically addressed using "master stream" fog nozzles (500 gpm or greater nozzles.) These nozzles offer both a straight stream and a fog pattern and are staged on a monitor because of the level of their reaction forces. The nozzle size and capacity of master stream nozzles might run to 10,000 gpm or greater. Such nozzles and monitors are typically staged on or outside of the industrial tank itself.

The industrial tanks for storing liquid petrochemicals and other chemicals are being constructed with ever increasing diameters. Diameters have grown from approximately 50 feet to over 300 feet in the last 25 years. (Storage tank walls are typically 50-60 feet high.) The increase in the size of the tanks is challenging the capacity of traditional master stream fog nozzles, staged a minimally safe distance from the tank and used for over the wall application. Traditional master stream fog nozzles are challenged today to reach the full extent of a tank surface in order cover the tank surface with a foam blanket, even in ideal conditions.

Practical factors that further affect the reach of nozzles include wind, heat and personal safety. Wind limits the staging of nozzles to the generally upwind side of the tank and can adversely affect the landing footprint of the foam. Heat and personnel safety can affect where nozzles can be staged in given circumstances. (Note: the necessity to stage crews closer to large tank fires in order to satisfy the range requirements for the nozzles has resulted in nozzle handles melting off due to heat.)

Master stream "fog" nozzles, as utilized for large industrial tank fires, typically discharge from an annular port surrounded by a sliding sleeve. The annular port is typically created by locating a baffle in the nozzle barrel. The sliding sleeve provides an adjustment of the nozzle discharge from the annular port from a straight stream pattern to a full fog pattern. The full fog pattern discharges significantly laterally to provide associated fire fighters and equipment protection from fire and heat, when or as needed.

The full fog pattern is usually achieved by sliding the sleeve back along the nozzle such that it reinforces, enhances or duplicates the swedge angle of the nozzle barrel downstream from the annular discharge gap. The swedge angle of the nozzle barrel is a beveled angle that helps guide the stream discharging from the annular port in its outer circumference. A swedge angle might provide approximately 40 degrees of latitude from the downstream direction. The straight stream pattern is typically achieved by sliding the sleeve forward in the downstream direction such that the liquid discharged from the annular discharge port through the gap, after being directed initially by the swedge angle of the nozzle barrel, becomes redirected by the sliding sleeve in a direction approximately parallel with the axis of the nozzle and/or the downstream direction.

Tests have shown that a straight stream pattern from an annular discharge port can frequently achieve greater range than a solid bore discharge port. At the least, testing shows that a proper straight stream pattern from a well designed annular port nozzle achieves at least 85% to 90% of the range of the very best solid bore nozzle designs in the industry where those solid bore nozzle designs are optimized for range at the same gpm.

Accord "A Guide to Automatic Nozzles," 1995, Task Force Tips.

A further benefit of the annular discharge port design ("fog" nozzle design) over the solid bore nozzle design when adjusted for a straight stream pattern is that the fog nozzle discharge lands in (what is referred to in the industry as) a footprint that is tightly defined. A predictable, tightly defined footprint enables the staging of nozzles so that application rate density plus foam run can be confidently relied upon to blanket a tank with foam within a requisite time period. The predictable, tightly defined footprint permits forming dependable strategies for attacks on a tank fire. Solid bore nozzles, on the other hand, although at times capable of being adjusted and designed for greater range for a given gpm, tend to have a "rooster tail" trajectory and discharge, producing a long narrow, more poorly defined landing footprint. Such poorly defined, large landing footprint is less useful in blanketing a tank with foam and less useful in forming dependable strategies for attacks upon a tank fire. The rooster tail trajectory and large landing pattern, further, is more vulnerable to being distorted, by wind, and thus rendered each is less reliable and predictable.

The trend of ever increasing tank diameter sizes, mentioned above, at times is placing increasing demands on the effective range of master stream fog nozzles. Nozzle range limitations, when other possible adverse effects of associated equipment, resources and environment are factored in, can create problems for the fire fighter.

Limitations of equipment, resources and environment affecting a nozzle's range include not only wind but limitations on staging, hose length, monitor design, pump capacity and water and head pressure. Any of these factors can result in the actual reduction of the range achievable by a nozzle in a given situation, a reduction to something below the design range of a nozzle. As a result, enhancing the range of a given size of a master stream fog nozzle is significant and valuable. However, a sacrifice of the predictable, tightly defined landing footprint and the fog capability of the nozzle for emergencies, is not acceptable.

A recent 285 foot tank seal fire in a tank of crude oil emphasized to the instant inventor the criticality of enhancing the range for a given gpm master stream fog nozzle even by 10%. A Daspit tool was developed and had been deployed that would allow for a four inch monitor and an associated 2000 gpm nozzle to be carried up a ladder or stairway of a tank and to be affixed to a tank side wall. From a personnel safety standpoint, the safest place to affix the tool is proximate the landing at the top of the stairway. These landings have railings. A five inch hose, brought up the wall to supply the fighting fluid to the nozzle and monitor, can blow its coupling or become uncoupled. A loose hose represents a substantial danger to personnel. The danger is immeasurably enhanced if, because of nozzle range limitations, fire fighters must utilize the four foot wide, railless gutter along a tank wall in order to stage a nozzle close enough so that the range covers the fire, instead of the landing with a railing. The use of the railless tank gutter was required at the 285 foot tank crude oil seal fire in order to achieve the necessary range. Subsequently, the instant inventor, strongly motivated, developed, by extensive and varied testing, the instant novel structure and design for extending the range of a given gpm master stream fog nozzle, surprisingly, without sacrificing the tight landing footprint characteristic of the traditional annular discharge port and without giving up fog capability.

(Note: increasing monitor size, e.g. from a four inch monitor to a five inch monitor, would decrease pressure loss in the monitor and would also increase a nozzle's range. However, increasing the monitor size to 5 inches tends to render existing monitors essentially non-portable by humans, in regard to carrying a monitor up a tank wall, and might over reach the water supply capability.)

The instant inventor had previously invented a Hydro-Chem and a DualFluid nozzle (see U.S. Pat. Nos. 5,167,285 and 5,312,041) which extended the range for throwing dry chemical or powder or particulate matter or $CO_2$ or other light material toward a fire. (The problem of throwing fire extinguishing powder has been likened to the problem of throwing feathers.) Extending the throw of dry powder and/or other light fluids to close to the range of water was accomplished by throwing the powder or light fluid within the initially hollow cylinder/cone pattern formed by the annular discharge orifice of a master stream fog nozzle, when set in a straight stream pattern.

The instant inventor was also familiar with and involved in the invention of a self-educting nozzle design. The self-educting fog nozzles have an inner straight bore for self-educting foam concentrate and for discharging the concentrate at the annular discharge port. See U.S. Pat. No. 4,640,461.

Although increasing the throw of water (or water/foam concentrate) is not like increasing the throw of a light material like powder, or "feathers," (e.g. the result sought by the inventor was not to extend the throw of "a light" fluid but rather to extend the throw of the water or foam itself), nonetheless, among his varied testing the instant inventor experimented with modifying a dual fluid and a self educting nozzle design in certain ways. That is, he experimented with throwing a solid stream of water within an annular stream of water, the annular stream being the stream of the normal hollow cylinder/cone of water thrown by a straight-stream adjusted master stream fog nozzle. He then compared throwing a solid bore stream of water with throwing an equivalent amount of water in an annular discharge straight stream pattern, and both with throwing an equivalent amount of water partially in a solid bore stream surrounded by water in an annular discharge straight stream pattern. (What holds for water is expected to hold for water/foam concentrate or foam.)

The surprising results were that throwing an appropriately structured solid stream of water within a hollow cylinder/cone discharge of an appropriately structured annular discharge, adjusted for straight stream pattern, resulted in a range of approximately that of the very best solid bore design alone (the solid bore design which had the longest range,) while retaining the annular stream's tight landing footprint. Thus, for the same gpm, with the new design range could be increased beyond that of throwing an annular stream alone while the tight landing footprint characteristic of the annular discharge, was retained. This proved true for a 50/50 split of the inlet water up to 90/10 split, bore to annular conduit. At a 90/10 bore/annular conduit split, range was increased essentially to the equivalent of the very best solid bore nozzle while the tight landing footprint pattern of the annular discharge port, adjusted for straight stream, was not sacrificed. The safety feature of the full fog option, of course, was retained. (An effective full fog option does not require a fog pattern for 100% of the water.)

The division of inlet water (or fluid) between the annular conduit and the straight bore conduit could be variously adjusted in the nozzle, when desired, by such means, for example, as screwing a baffle in or out and/or by replacing a bore/baffle tip. For most operations a 50/50 split of the water might optimize the combination of range and tight landing footprint. A 90/10 split, however, could be used when range was the highest priority while a fog capability was still important for safety purposes. The desired gpm of the nozzle might affect the choice, also.

Once the invention was made, it clearly also had application to even smaller nozzles, such as from a 95 gpm to a 500 gpm nozzle size. Such lower gpm nozzles may be hand held.

To recap, for a given gpm, the very best range optimized solid bore nozzle design might achieve a 10% to 15% greater range than a range optimized fog nozzle design, adjusted for straight stream. However, a range optimized solid bore nozzle can not demonstrate a reliable tight landing footprint while achieving its optimized range. Surprisingly, testing now shows that a 50/50 to a 90/10 combination (split of water between a solid bore and an annular port respectively) of a solid bore with an annular design, range optimized and adjusted for straight stream, achieves the same or almost the same range as the very best solid bore designs without sacrificing the tight landing footprint characteristic of the annular bore design, and while providing full fog capability. (The ratios reflect the proportion of bore liquid to annular liquid.) The instant inventor speculates that the cylinder/cone discharge pattern of the annular port design where adjusted for straight stream creates a low pressure area within which may help preserve the energy of the solid stream and provide an envelope to preserve the annular bore landing pattern.

SUMMARY OF THE INVENTION

The invention comprises an at least a 95 gpm (at 100 psi) range and landing pattern optimized fog nozzle for fire fighting, including a nozzle inlet in fluid communication with a source of fire fighting liquid. The nozzle includes an annular conduit, in fluid communication with the inlet, having an annular discharge port. A sleeve surrounds the annular discharge port and is adjustable to extend downstream from the annular port. The annular port and sleeve are structured together and structured together and adjustable in combination to discharge a straight stream or a fog pattern. A solid bore conduit is also in fluid communication with the inlet, having a discharge port located radially inward of the annular conduit and discharge port. The solid bore conduit and port are structured to discharge at least 50% of the nozzle discharge.

The nozzle provides generally laminar flow in both the annular conduit and the bore conduit, from the nozzle inlet to the discharge ports. Generally laminar flow should be understood to include, at least, in the nozzle avoiding 90 degree or more turns of the fluid flow. Fluid flow in the conduits must be squeezed to discharge out of a gap, in order to optimize and maximize the head pressure defining the nozzle range and fluid velocity. Providing general laminar flow avoids significant distortion of the fluid flow path in the nozzle prior to the point of reduction to the discharge gap. Inducing a swirl pattern of the flow through the nozzle can be consistent with general laminar flow, as some nozzle designers suggest that inducing a designed swirl pattern actually minimizes turbulence and thus energy loss.

Preferably the annular discharge port has an outward swedge angle of less than or equal to 50°. More preferably, the swedge angle is between 30° to 40°. Preferably a stream straightener is located approximately mid-nozzle in the annular conduit and a further stream straightener is also located proximate an inlet of the bore conduit. The inlet water is divided between the bore conduit and the annular conduit in a ratio of between 50/50 to 90/10. bare to annular.

The invention also includes a method of fighting fires including discharging at least 50% of a nozzle inlet fire fighting liquid through a solid bore conduit and discharging at least 10% of the inlet fire fighting liquid through an annular discharge port, located radially outward of the solid discharge port. The methodology includes adjusting a sliding sleeve to a straight stream pattern for the annular discharge.

The methodology includes structuring the nozzle to provide generally laminar flow for both the annular discharge liquid and the solid bore discharge liquid. Preferably also the methodology includes providing an outward swedge angle of from between 30° to 40° for the annularly discharged liquid. Preferably also the methodology includes providing an annular conduit stream straightener approximately mid nozzle and providing a solid bore stream straightener proximate an inlet to the solid bore conduit.

BRIEF DESCRIPTION OF THE DRAWINGS

A better understanding of the present invention can be obtained when the following detailed description of the preferred embodiments are considered in conjunction with the following drawings, in which.

Figure 1A:
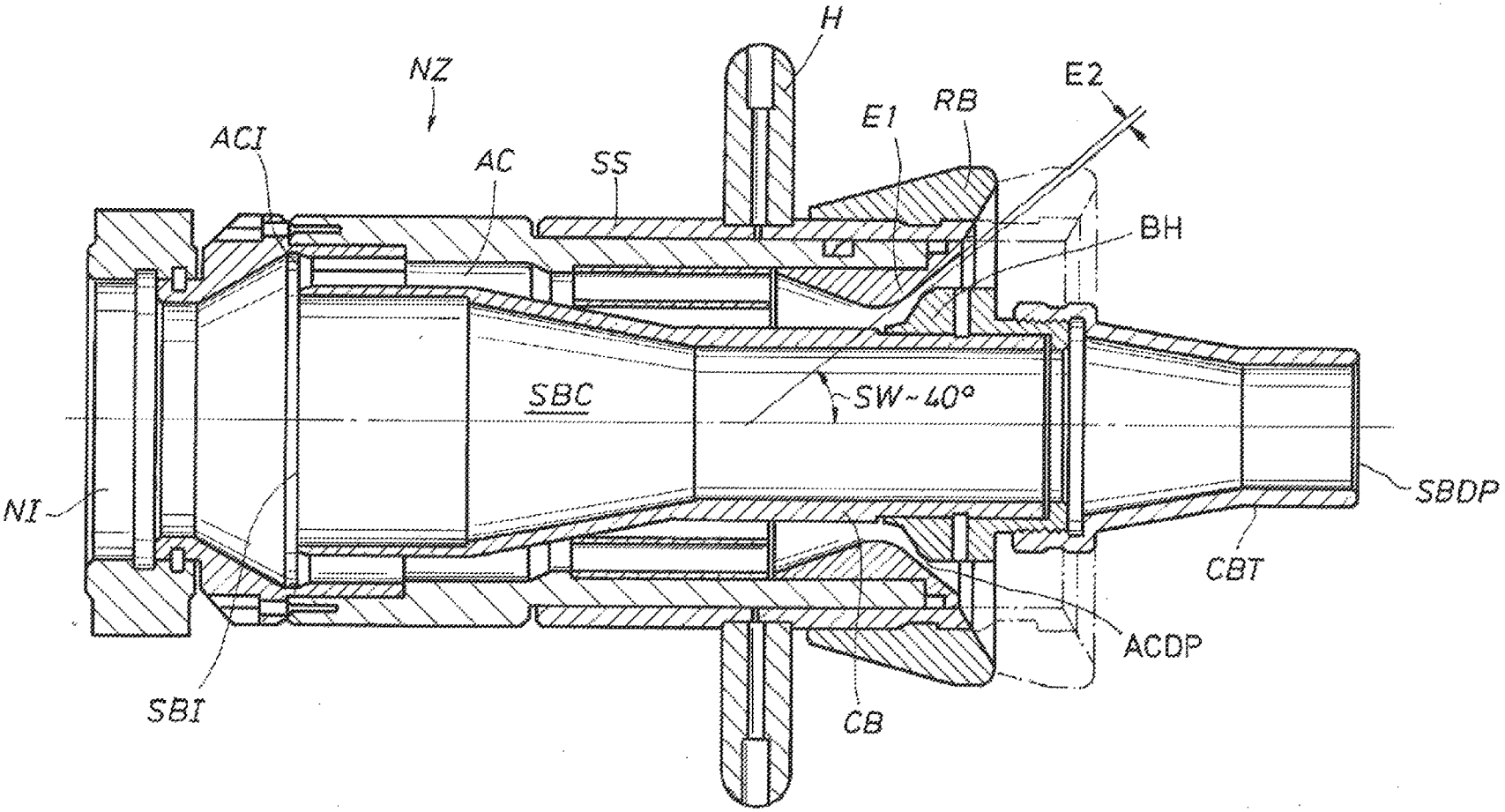
FIGS. 1A and 1B illustrates aspects of a preferred embodiment of the instant invention, the nozzle in these figures set for a ratio of solid bore discharge port to annular conduit discharge port of between 50/50 and 90/10.
Figure 1B:
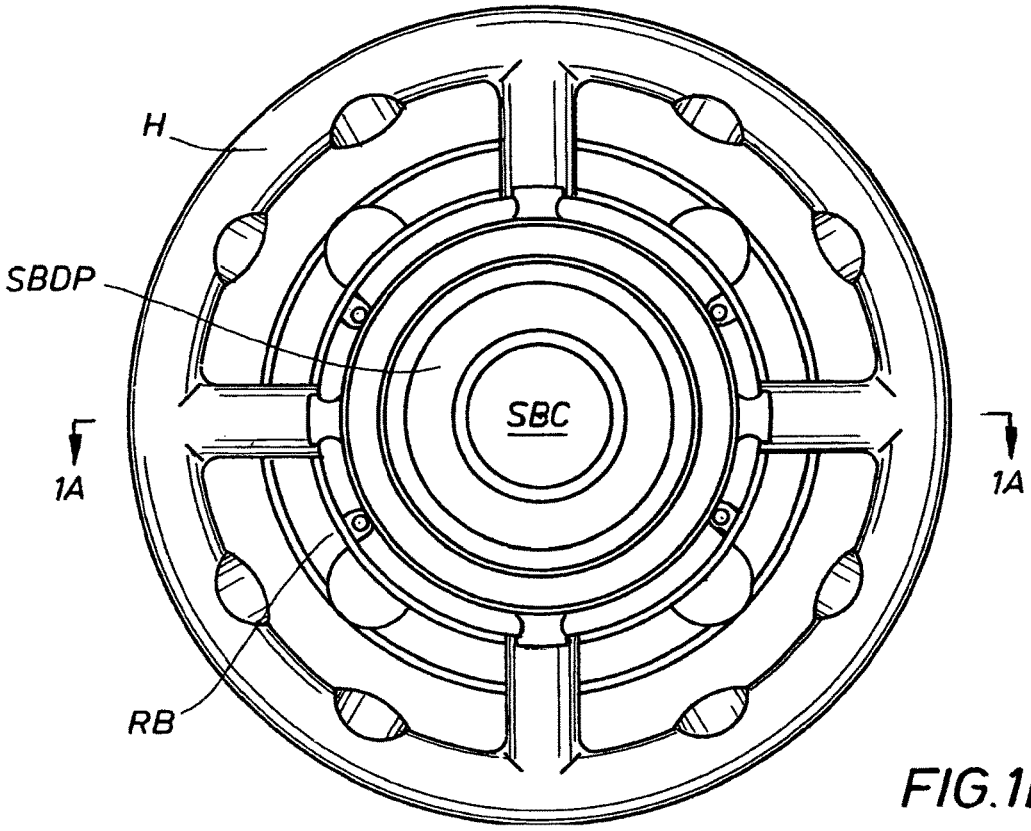

The drawings are primarily illustrative. It would be understood that structure may have been simplified and details omitted in order to convey certain aspects of the invention. Scale may be sacrificed to clarity.

DESCRIPTION OF THE PREFERRED EMBODIMENTS

To clarify the use of language and terms herein, "solid bore" is used to indicate a conduit with a solid crosssectional area. An "annular bore" defines a conduit with an annular crosssectional area. A "solid bore" nozzle has a discharge orifice that defines a solid crosssectional area. An annular bore or "fog" nozzle has a discharge orifice that defines an annular crosssectional area. Fire fighting nozzle discharge ports generally have one of these two structural configurations, "solid bore" or "annular bore." The annular bore design is frequently referred to as "fog" design.

"Fog" nozzles are typically provided with a sliding outer sleeve, over the annular discharge orifice, which is used to select and to alternate between a "fog pattern" or a "straight stream pattern." The annular discharge bore and port and sliding sleeve are structured in combination to provide this selection. A "straight stream pattern" of a fog nozzle optimizes its range. The straight stream discharge typically assumes the shape, at least initially, of a hollow cylinder or cone. The cone could either slightly flare out or slightly flare in. A full fog pattern is created when the nozzle discharges its fluid in a wide amplitude, a cone shape that significantly flares out, achieved with the sleeve back, and is usually used to cover and protect the fire fighter and associated equipment.

Typically, the crosssectional area defined by a nozzle discharge port is smaller than the crosssectional area defined by the nozzle inlet. Reducing the crosssectional discharge area of the discharge port, or gap, permits recovery of head pressure at the discharge. The result is a discharge stream may be of somewhat lesser gpm but has greater range than that of a completely uniform bore.

Range optimized solid bore nozzles may use stream straighteners at the entrance to the solid bore conduit to enhance laminar flow, and to reduce energy lost in turbulence through the conduit and to increase range. Providing laminar flow, again, is to be interpreted herein to mean providing a relatively smooth conduit for the liquid, free of significant lateral turns, especially 90 degrees turns.

The outward swedge angle, sometimes referred to as the "cut," of a fog nozzle is a flow angle defined by a beveled surface of the annular conduit barrel subsequent to (i.e. downstream of) the squeeze point or gap of an annular discharge port, and prior to intersection with a longitudinal portion of a surrounding sleeve. (If the outward swedge angle is not constant in a nozzle design, its average effective value should be used herein.)

The phrase cylinder/cone discharge is used herein to indicate the shape of a straight stream discharged from an annular discharge port, the port of a fog nozzle design, adjusted to a straight stream pattern by a sliding sleeve or the like. This shape initially at least resembles a hollow cylinder or cone. The cone shape would be either of slightly increasing diameter or of slightly decreasing diameter. Fine adjusting of the shape of the cylinder/cone discharge pattern by the fire fighter is known in the art to optimize the straight stream pattern for range and for the landing footprint for that nozzle.

The phrase water/foam concentrate is used to indicate a stream of liquid including water and/or foam concentrate. It should be understood that the water and/or foam concentrate may have already, at least partially, converted to foam. A stream of water/foam concentrate is assumed to perform similarly to a stream of water for range testing purposes.

Subsequent to the initial discovery above, the instant inventor discovered that Akron Brass (AB) had a dual port nozzle (commercially called the Saberjet, U.S. Pat. No. 6,877,676) which reminded the instant invention of an old dual port Navy nozzle, where either a solid bore port or an annular port could be selected. In some models both ports of the Akron Brass nozzle could be selected simultaneously. Inspection has shown, however, that the Akron Brass dual port nozzle is not designed to optimize range. It appears to provide fog capability simultaneously with a solid bore discharge, but importantly, the AB nozzle does not provide for laminar flow through the annular conduit. (In fact, the annular conduit flow in the nozzle makes two 90 degree turns in route to the annular discharge port.) Clearly the annular conduit is not regarded as being able to enhance the range or the landing pattern of the nozzle. The AB nozzle also teaches and embodies no stream straighteners, either for the annular discharge conduit or for the solid bore conduit. This point emphasizes again that maximizing range was not a prime objective. The annular discharge swedge angle of the AB nozzle is also not designed or disclosed for range optimization of the annular discharge in a straight stream pattern, either as per the instant invention.

The instant invention, by contrast, is novel in that it not only provides a simultaneous dual port, nozzle having a solid bore and a master stream fog nozzle design, but the instant inventive nozzle is structured such that it optimizes range and landing pattern, managing to achieve the best of both designs. The instant invention is based on the discovery that a range optimized solid bore nozzle design and a range optimized annular bore nozzle design can be combined and deployed simultaneously to retain close to the best solid bore nozzle design range while retaining the annular bore nozzle design tight landing pattern, as well as full fog capability. Thus, the instant invention retains key advantages of each design while a limitation of each design is minimized.

FIGS. 1A, 1B, 2A and 2B illustrate aspects of preferred embodiments of prototypes of the instant invention. Nozzle NZ provides a nozzle inlet NI. Preferably, although not necessarily, downstream of nozzle inlet NI is solid bore inlet SBI and an annular conduit inlet ACI. In the adjustment shown in FIGS. 1A and 1B, affected by a changeable solid bore tip CBT, between 50% to 90% of the fire fighting fluid will flow through the solid bore inlet and out the solid bore discharge port SBDP. The crosssection view provided by sections 1A and 2A illustrate aspects of the annular conduit AC and solid bore conduit SBC. Solid bore conduit SBC initially reduces in crosssectional area and diameter, at an indicated angle, approximately 6.5 degrees in FIG. 2A. The tip of the solid bore conduit SBC of FIG. 2 has been further diminished in diameter. That is, the solid bore conduit is shown in this embodiment as slightly further narrowed or further pinched in at its discharge port. In FIG. 1 a selectable center bore tip CBT has been selected to further reduce the area of the solid bore discharge SBDP. Bafflehead BH, also referred to as an annular conduit discharge port defining element E2, is shown squeezed against annular conduit discharge port defining element E1 to yield an annular discharge gap width of 0.117 inches. In this configuration 10% to 50% of the fire fighting fluid could exit the annular conduit discharge port ACDP, depending upon the solid bore discharge tip selected.

Figure 2B:
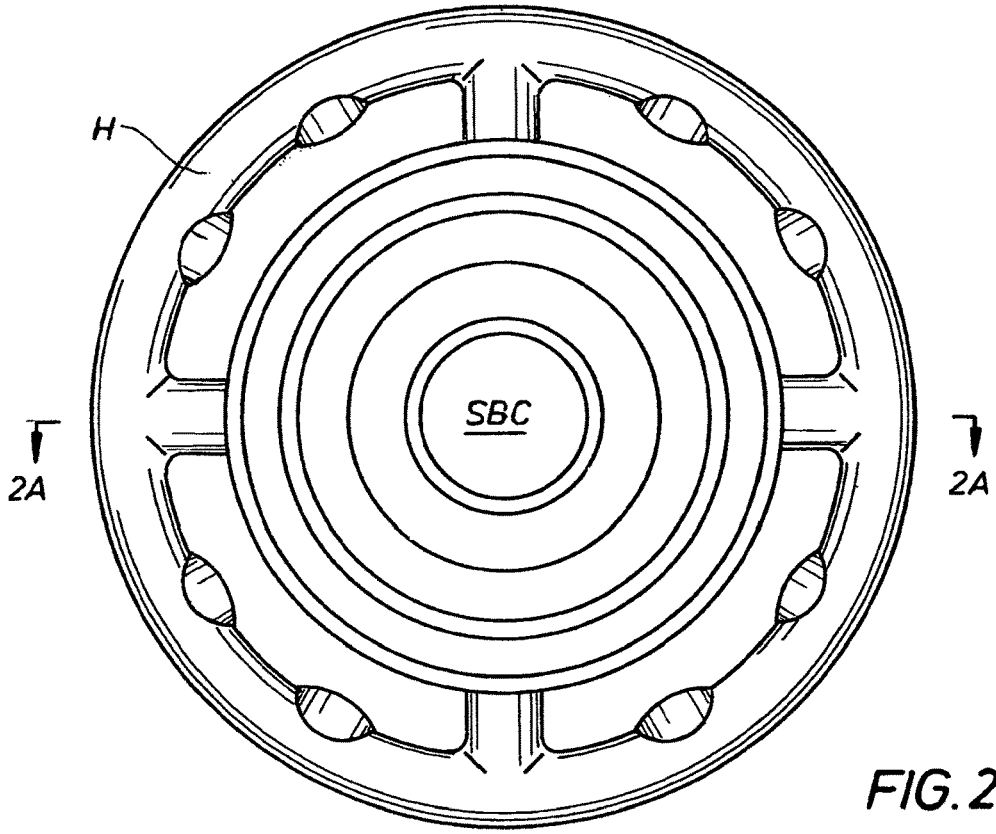
FIGS. 2A and 2B illustrates an alternate embodiment where an approximate 90/10 ratio of solid bore discharge port to annular bore discharge port is illustrated.
Figure 2A:
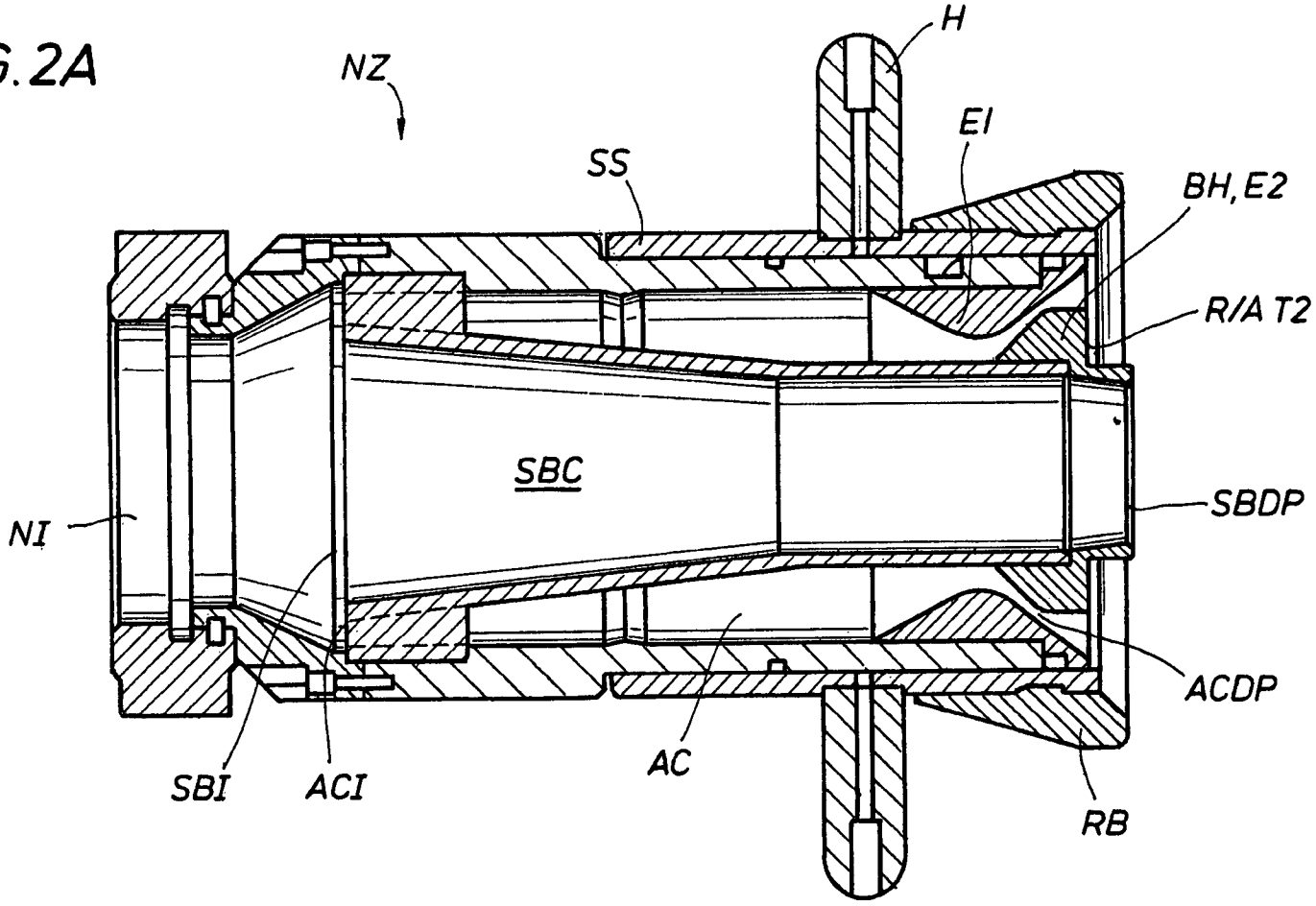

Element E1 is shown defining a swedge angle SW of approximately forty degrees with respect to the axis of the nozzle NZ. FIGS. 1A and 2A present a water inlet NI of 3.5 inches. The solid bore discharge port of FIGS. 2A and 2B has a diameter of less than 2.25 inches. Such dimensioning of a nozzle can be used to yield a roughly 1500 gpm nozzle at a supply head pressure of approximately 100 psi at the nozzle inlet, depending upon the solid bore tip selected. Exact dimensioning to achieve 1500 gpm would have to be determined by testing and trial.

Sliding sleeve SS is shown with typical handles H and rubber bumper RB. The sliding sleeve, preferably by a quick one-quarter rotation, slides longitudinally downstream of the nozzle from its fog orientation shown in FIGS. 1A and 2A. Sliding sleeve SS downstream longitudinally on the nozzle creates a straight stream pattern for the fire fighting fluid exiting the annular discharge port ACDP. Again, those of skill in the art of using master stream fog nozzles understand to make minor adjustments to sliding sleeve SS position with respect to nozzle NZ such that the optimum range for fluid exiting the annular discharge port in a straight stream pattern can be achieved for that nozzle.

FIG. 2A illustrates the nozzle adjusted for an approximate 90/10 ratio, solid bore conduit vis-à-vis annular conduit. The embodiment of FIGS. 2A and 2B achieves its 90/10 ratio by means of an exchangeable tip. Note that exchangeable tip R/AT2 of FIG. 2 is different from exchangeable tip CBT of FIG. 1A or 1B. (Tips could be exchanged by screwing off and on or the like.) Tip R/AT2 not only slightly narrows the solid bore discharge port, from approximately 2.25 to approximately 2.04 inches, but adjusts the gap between elements E1 and E2 to a width of approximately point 0.122 inches. The actual dimensions for any given nozzle, again, can be refined by testing. The instant dimensions illustrate a starting point. One goal may be to create a nozzle at a 90/10 ratio discharge, solid port to annular discharge port, such that the total discharge is approximately 1500 gpm. Alternately, a positive annular conduit discharge port ACDP could be created by a tip that simply opened up, such as by screwing out tip R/AT2, without exchanging tips. In such case the solid bore discharge port would remain the same size and the annular conduit discharge port would vary. Such nozzle should discharge somewhat greater than 1500 gpm. For some nozzle applications, such a variation in flow would not be a problem.

Alternately, not shown in a drawing, is a 50/50 ratio of discharge, solid bore to annular discharge port, that could be achieved in ways analogous to the above. E.g. replaceable/adjustable tips could be screwed onto the end of the structure creating the solid bore conduit, decreasing the discharge port of the solid bore conduit. Alternately, or in addition, the tip could increase or change the discharge port of the annular conduit. A tip at the end of the structure creating the solid bore could be adjusted, as by screwing in and out, such that the annular conduit discharge port enlarges while the solid bore discharge port diameter remains the same. With such designs, the total gpm of the nozzle could vary.

Figure 3A:
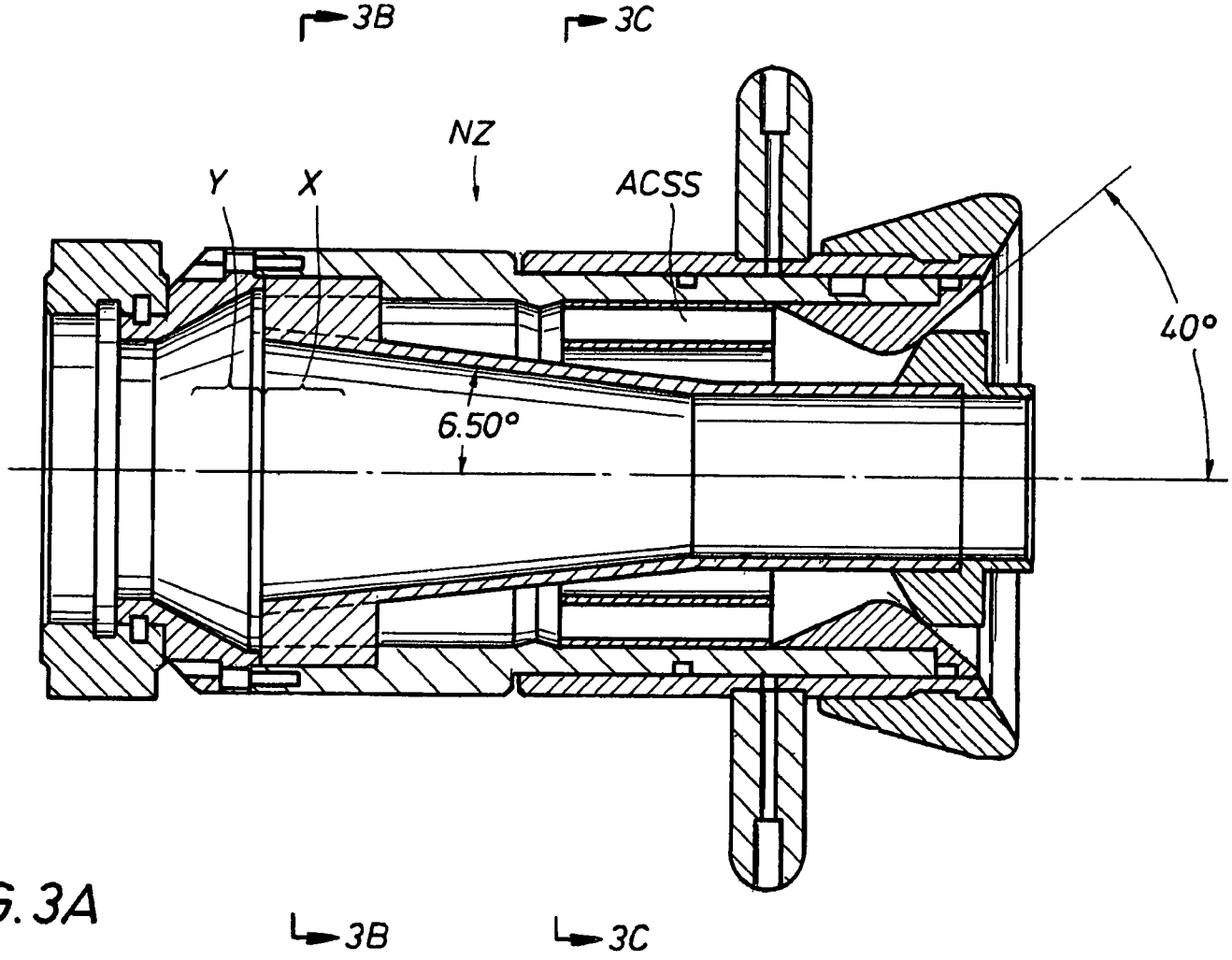
FIGS. 3A and 3C illustrates placement of a stream straightener in the annular conduit and the location for a stream straightener for the solid bore conduit.
Figure 3B:
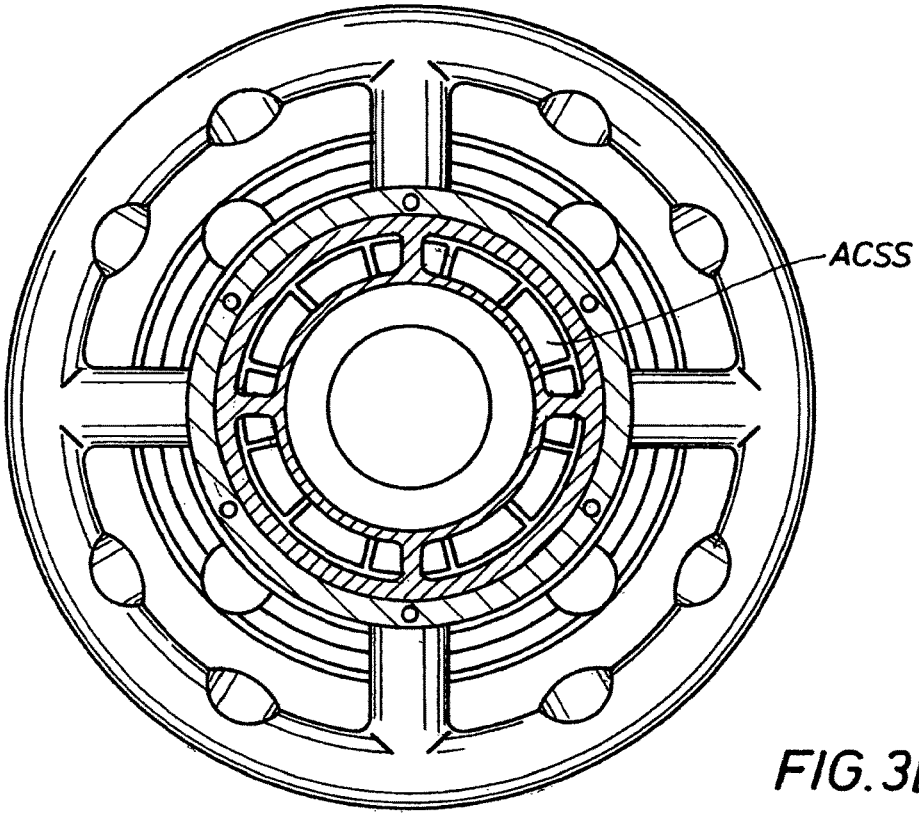
FIGS. 3D and 3E illustrate a stream straightener SBSS, of a design as sold by Elkhart Brass, located in or proximate to an inlet of a solid bore conduit, more particularly, at locations X and Y as indicated in FIG. 3A.
Figure 3C:
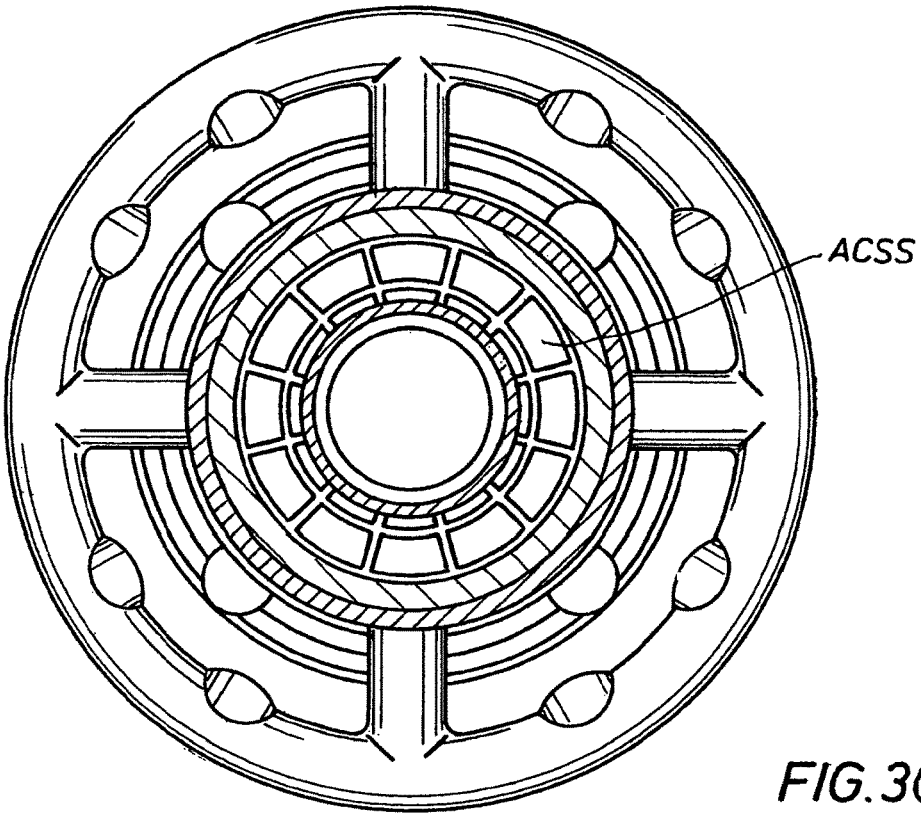

FIGS. 3A-3C illustrates in particular the placement of stream straighteners in a nozzle NZ similar to FIGS. 1A, 1B, 2A and 2B. Annular conduit stream straightener ACSS is illustrated placed against the inner wall of the nozzle annular bore, proximately mid nozzle and extending toward the annular discharge port. A preferred annular conduit stream straightener would run two to three inches in length in the illustrated approximately 1500 gpm nozzle. Locations X and Y illustrate a preferred place for placing stream straighteners for the solid bore conduit. Such stream straighteners for solid bore conduits are known in the art and can be found illustrated, for instance, in the Elkhart Brass catalogue.

Figure 4:
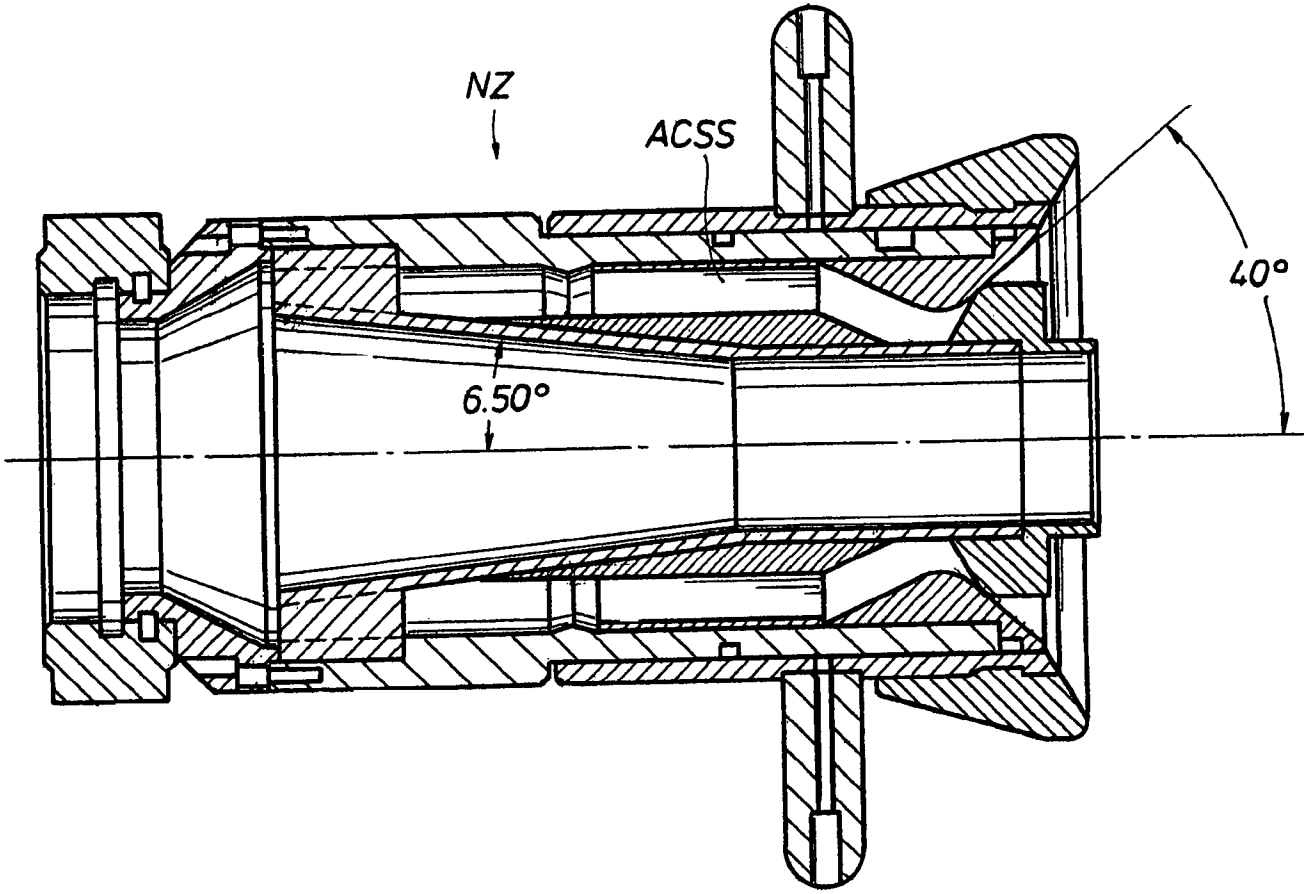
FIGS. 4 and 5 illustrate possible additions to or changes to the nozzle body in order to restrict increases in crosssectional area of the annular conduit through the body of the nozzle.
Figure 5:
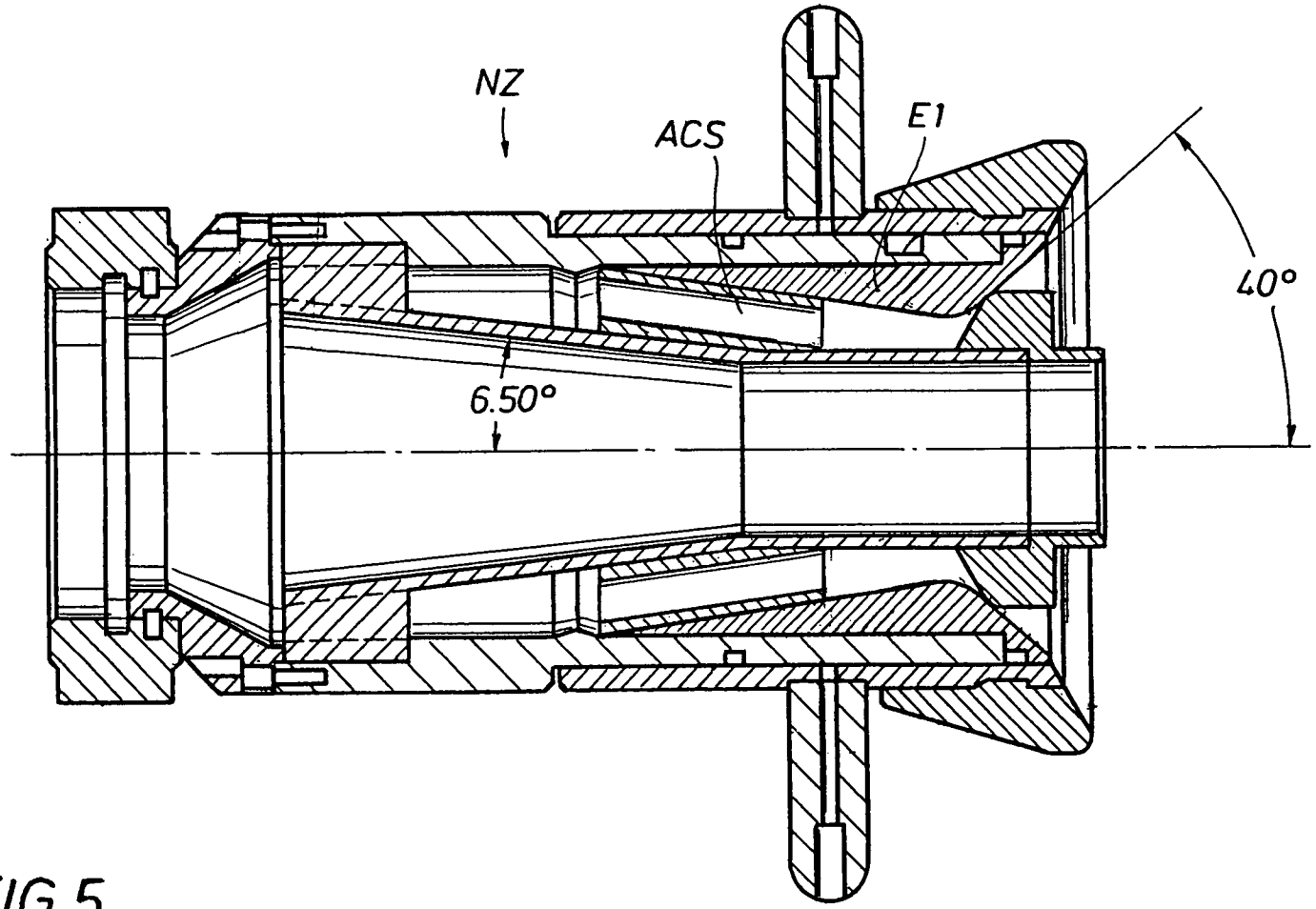

FIGS. 4 and 5 illustrate additional potential means for restricting increase in crosssectional area of the annular conduit through the nozzle. Structure ACS is illustrated on the inside of the annular conduit in FIG. 4 and on the outside of the annular conduit in FIG. 5. In fact, in FIG. 5 the additional structure ACS is incorporated into element E1 that partially defines the annular conduit discharge port. Annular conduit stream straighteners can be adapted to adjust to the presence of such additional structures ACS. The function of additional structures ACS would be to limit the increase in crosssectional area of the annular conduit AC through the nozzle to control energy loss. Structure ACS would preferably be formed of aluminum or plastic or other like yet durable materials. Structure ACS could be incorporated into an annular conduit stream straightener. When the annular conduit is allowed to increase in crosssectional area, water flowing through the annular conduit is decelerated. Acceleration can be recovered at the discharge port but only with some loss in energy and efficiency. Hence, significant deceleration through the nozzle is disfavored.

It can be seen from review of FIGS. 1 through 5 that the annular conduit is designed in general to preserve laminar flow of the fire fighting fluid, from the nozzle inlet NI to the annular conduit discharge port ACDP. The same is true for the flow through the solid bore conduit. Unnecessary obstructions in the conduit cause friction, turbulence and loss of energy. Such is disfavored in nozzles designed to optimize the range of the thrown stream.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below. Since the foregoing disclosure and description of the invention are illustrative and explanatory thereof, various changes in the size, shape, and materials, as well as in the details of the illustrated device may be made without departing from the spirit of the invention. The invention is claimed using terminology that depends upon a historic presumption that recitation of a single element covers one or more, and recitation of two elements covers two or more, and the like. Also, the drawings and illustration herein have not necessarily been produced to scale.

What is claimed is:

1. An at least 95 gpm, at 100 psi, range and landing pattern optimized, fog nozzle for fire fighting, comprising:

the nozzle having elements defining a nozzle inlet in fluid communication with a source of fire fighting liquid;

an annular conduit in fluid communication with the inlet, having an annular discharge port and outward swedge angle;

a sleeve surrounding the annular discharge port, adjustable to extend downstream from the elements defining the annular discharge port and outward swedge angle, the annular port and sleeve structured and adjustable in combination to discharge both a straight stream and a fog pattern from the annular port, including alternately;

a solid bore conduit in fluid communication with the nozzle inlet, having a solid bore discharge port forming a discharge port of the nozzle, located radially inward of the annular conduit and discharge port, the solid bore conduit and port sized and structured to discharge at least 50% of the nozzle discharge;

a stream straightener in the annular conduit, located approximately mid-nozzle;

a stream straightener for the bore conduit located proximate to or upstream of an inlet of the bore conduit; and wherein the annular discharge port has an outward swedge angle of between 30 degrees to 50 degrees;

the solid bore conduit, annular conduit, adjustable sleeve, bore conduit stream straightener, annular conduit stream straightener and outward swedge angle structured in combination to maximize nozzle discharge range and tightness of discharge landing pattern.

2. The nozzle of claim 1 wherein the nozzle provides generally laminar flow in both the annular conduit and the bore conduit from the nozzle inlet to the discharge ports, and wherein the stream straightener in the annular conduit divides the conduit into at least four sections.

3. The nozzle of claim 2 wherein the annular discharge port has an outward swedge angle of approximately 40 degrees.

4. The nozzle of claim 2 wherein the annular discharge port has an outward swedge angle of between 30° to 40°.

5. The nozzle of claim 1 wherein each discharge port squeezes fluid flow in the conduit to discharge out of a gap.

6. The nozzle of claim 2 wherein each discharge port squeezes fluid flow in the conduit to discharge out of a gap.

7. The nozzle of claim 1 or 2 structured to flow at least 500 gpm.

8. The nozzle of claim 1 or 2 wherein the solid bore conduit and annular conduit are co-axial and significantly coextensive.

9. The nozzle of claim 8 wherein the nozzle provides the annular conduit and the solid bore conduit structured such that the cross-sectional area of each conduit does not increase more than 30% in the nozzle from a conduit inlet until the conduit discharge port.

10. The nozzle of claim 1 or 2 structured such that the inlet fire fighting fluid is divided between the solid bore and annular bore in a discharge ratio of between 50/50 to 90/10, solid bore to annular conduit.

11. The nozzle of claim 1 or 2 wherein at least one of the solid bore discharge port and annular discharge port are structured to adjust in diameter by replacing or adjusting a nozzle discharge tip element.

12. The nozzle of claim 1 or 2 wherein the annular conduit discharge port is defined by two elements that relatively adjust.

13. The nozzle of claim 12 wherein the two elements that relatively adjust include a first element that is replaceable with a second element, thereby permitting adjustment in size of the annular conduit discharge port.

14. The nozzle of claim 1 or 2 wherein the solid bore discharge port is adjustable by replacing a first solid bore tip element with a second solid bore tip element.

15. The nozzle of claim 14 wherein the replaceable solid bore tips adjust the gpm of the nozzle.

16. The nozzle of claim 14 wherein the replaceable solid bore tips adjust the discharge ratio of the solid bore and annular conduit.

17. A method for fighting fires, comprising:

from a combination fog and solid bore nozzle for fire fighting including a solid bore conduit with a solid bore discharge port forming a discharge port of the nozzle, an annular conduit having an annular discharge por with an outward swedge angle, an adjustable sleeve, a bore conduit stream straightener located proximate to or upstream of an inlet of the bore conduit and an annular conduit stream straightener located proximately mid-nozzle, the conduits, discharge ports, stream straighteners and swedge angle structured in combination to provide generally laminar flow through both conduits, discharging at least 50% of a nozzle inlet fire fighting liquid through the solid bore conduit and solid bore discharge port in a solid bore stream from the nozzle;

discharging at least 10% of the inlet fire fighting liquid through the annular discharge port located radially outward of the solid discharge port, the annular discharge port having an outward swedge angle of between 30 degrees and 50 degrees; and adjusting the sleeve to achieve a straight stream pattern for the annular discharge such that the discharge range and tightness of discharge landing pattern from such combined discharge are maximized.

18. The method of claim 17 including the annular discharge port squeezing fluid flow to discharge out of a gap.

19. The method of claim 17 including the solid bore discharge port squeezing fluid flow to discharge out of a gap.

20. The method of claim 18 including a solid bore port squeezing fluid flow to discharge out of a gap.

21. The method of claim 17 including the annular conduit stream straightener located approximately mid-annular conduit and the bore conduit stream straightener located proximate to or upstream of a bore conduit inlet.

22. The method of claim 17 that includes discharging at least 500 gpm.

* * * * *